United States Patent [19]

Masuda et al.

[11] 4,115,071

[45] Sep. 19, 1978

[54] CATALYTIC CONVERTER HAVING IMPROVED SUPPORTING MEMBERS FOR MONOLITHIC CATALYST

[75] Inventors: Tetsuzo Masuda, Hachioji; Tomiyasu Tagawa; Hachiro Yoshioka, both of Yokohama; Takashi Akahoshi, Yokosuka, all of Japan

[73] Assignee: Nissan Motor Company, Limited, Japan

[21] Appl. No.: 740,225

[22] Filed: Nov. 9, 1976

[30] Foreign Application Priority Data

Nov. 14, 1975 [JP] Japan ..... 50/154694[U]

[51] Int. Cl.[2] ..... F01N 3/15

[52] U.S. Cl. ..... 422/179; 165/81; 165/82; 60/299; 422/180

[58] Field of Search ..... 23/288 FC; 165/81, 82; 181/61, 62

[56] References Cited

U.S. PATENT DOCUMENTS

| | | | |
|---|---|---|---|
| 1,912,785 | 6/1933 | Mills | 165/81 |
| 3,041,149 | 6/1962 | Houdry | 181/81 X |
| 3,692,497 | 9/1972 | Keith et al. | 23/288 FC |
| 3,854,888 | 12/1974 | Frietzsche et al. | 23/288 FC |
| 3,876,384 | 4/1975 | Santiago et al. | 23/288 FC |

*Primary Examiner*—James H. Tayman, Jr.
*Attorney, Agent, or Firm*—Lane, Aitken, Dunner & Ziems

[57] ABSTRACT

The catalytic element is supported at its both longitudinal ends by two supporting members which are secured to the inner surface of a casing. Each supporting member is formed with a plurality of slits for releasing thermal stresses generated therein due to a high temperature within the casing when used.

5 Claims, 5 Drawing Figures

CATALYTIC CONVERTER HAVING IMPROVED SUPPORTING MEMBERS FOR MONOLITHIC CATALYST

This invention relates generally to a catalytic converter for use in an exhaust system of an automotive internal combustion engine and, more particularly to a catalytic converter of the type in which a monolithic catalytic element is secured within a casing thereof.

It is a main object of the present invention to provide an improved catalytic converter having a monolithic catalytic element therein, which converter is constructed so that the catalytic element is not damaged or broken by the application of local mechanical force thereto due to the thermal deformation of the supporting members supporting the catalytic element.

It is another object of the present invention to provide an improved catalytic converter having supporting members for securely supporting a monolithic catalytic element within a casing, in which the supporting members are formed with slits to release the thermal stresses generated therein in order to prevent thermal deformation of the supporting members, thereby preventing the application of local mechanical force and accordingly damage to the monolithic catalytic element.

Other objects, features and advantages of the catalytic converter in accordance with the present invention will become more apparent as the following description of preferred embodiments thereof progresses, taken in conjunction with the accompanying drawings in which like reference numerals designate like parts and elements, and in which.

Figure 1:
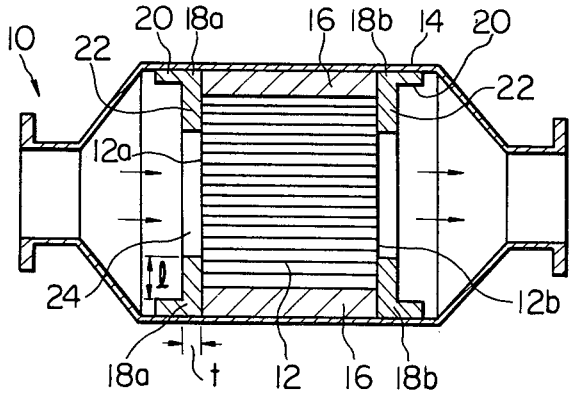
Fig. 1 PRIOR ART
FIG. 1 is a schematic sectional view of a prior art catalytic converter.

With reference to FIG. 1, there is shown a prior art catalytic converter 10 of a type in which a cylindrical monolithic type catalytic element 12 is located within a cylindrical casing 14. In general, such a type of catalytic element 12 is made of a brittle material such as ceramics and accordingly is liable to be damaged by severe vibration and local mechanical force applied thereto. Accordingly, the catalytic element 12 is supported, within the casing 14, in its radial direction by a supporting member 16 which is disposed between the inner surface of casing 14 and the outer surface of the catalytic element 12, and at its both ends by two opposite similar supporting members 18*a* and 18*b*. As shown, each of the supporting members 18*a* and 18*b* is formed of cylindrical flange portions 20 secured to the inner surface of the casing 14 and radial annular disc portions 22 integral with the flange portions 20. The radial annular disc portions 22 are in contact with the end portions of the opposite and parallel annular planes 12*a* and 12*b* of the catalytic element 12, respectively.

It is to be noted that the radial length $l$ of the radial annular disc portion 22 is designed to be relatively small to provide a relatively large area of the opening 24 defined by the annular disc portion 22 in order to obtain an increased flow amount of the exhaust gases passing through the converter 10 and an increased contacting area of the catalytic element 12 with the exhaust gases flowing into the converter 10. Additionally, the radial annular disc portion 22 of the supporting member 20 is generally designed to be small in its thickness $t$.

Since the prior art converter 10 is constructed as described above, particularly in its supporting members 18*a* and 18*b* for supporting the catalytic member 12 at its both ends, it has encountered problems in which the radial annular disc portions 22 of the supporting members 18*a* and 18*b* are thermally warped by a high temperature of the exhaust gases passing through the converter 10, applying severe local mechanical force to the peripheral portions at the annular planes 12*a* and 12*b* of the catalytic element 12. Therefore, the peripheral portions of the annular planes 12*a* and 12*b* of the catalytic element 12 are liable to be damaged or destroyed.

In order to overcome the above-described problems encountered in the prior art, the present invention contemplates to present warping of the radial annular disc portions of the supporting members supporting the catalytic element in its longitudinal direction, by forming a plurality of radial slits in the radial annular disc portion.

Figure 2:
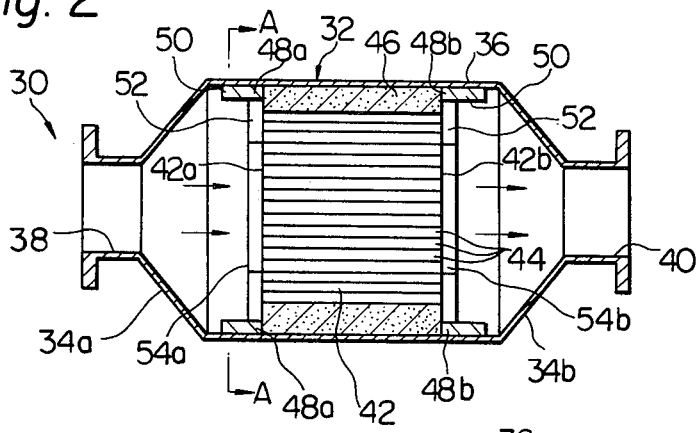
FIG. 2 is a schematic sectional view of a preferred embodiment of a catalytic converter according to the present invention.
Figure 3:
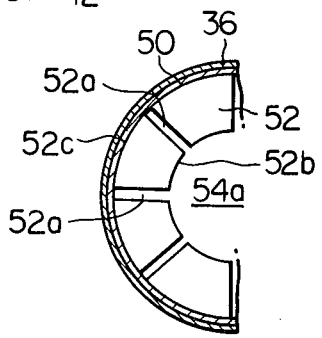
FIG. 3 is a cross-sectional view taken along a line A—A of FIG. 2, showing an example of a supporting member used in the catalytic converter of FIG. 2.
Figure 4:
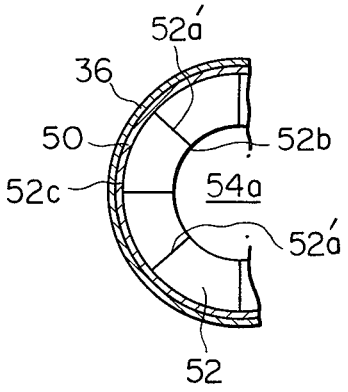
FIG. 4 is a cross-sectional view similar to FIG. 3, but showing another example of the supporting member used in the catalytic converter of FIG. 2.

Referring now to FIGS. 2 to 4, a preferred embodiment of a catalytic converter 30 in accordance with the present invention is shown. The catalytic converter 30 comprises a metal casing 32 which is formed of frusto-conical end closure portions 34*a* and 34*b* integral with a cylindrical portion 36. The frusto-conical end closure portion 34*a* has at its central portion a gas inlet 38 communicable with the combustion chambers of an automotive internal combustion engine (they are not shown). The frusto-conical end closure portion 34*b* has at its central portion a gas outlet 40 communicable with the atmosphere to emit purified exhaust gases into the atmosphere. Additionally, the frusto-conical portion 34*a* is so dimensioned as to enable distribution or passage of the exhaust gases over the entire or substantially entire cross-sectional area of the cylindrical portion 36 of the casing 32. The other frusto-conical portion 34*b* is of similar dimensions as the frusto-conical portion 34*a* as shown, and of such dimensions as to enable free passage of gas out of the converter without causing substantial back pressure.

Disposed within the cylindrical portion 36 of the casing 32 is a catalytic element or catalyst 42 which is made of a refractory material such as ceramics and is generally cylindrical and of unitary solid skeletal structure (honeycomb type) having a plurality of gas flow channels or paths 44 therethrough. The catalytic element 42 has two opposite and parallel end planes 42*a* and 42*b*. The plane 42*a* faces the gas inlet 38 to introduce the exhaust gases from the gas inlet 38 into the gas flow channels 44 of the catalytic element 42, and the end plane 42*b* faces the gas outlet 40. A catalytic material such as a platinum group metal is carried on the inner surfaces of the channels 44. Within a cylindrical space (no numeral) defined between the inner surface of the cylindrical portion 36 of the casing 32 and the outer surface of the catalytic element 42, a supporting member 46 is disposed to support the catalytic element 42 in its radial direction and concentrically to the cylindrical portion 36 of the casing 32. The cylindrical space extends completely around the catalytic element 42 along the entire length of the catalytic element 42. The supporting member 46 is formed to prevent the exhaust gases from by-passing the catalyst and is accordingly formed of packed asbestos or ceramic fibers to serve as a sealing member.

Reference numerals 48*a* and 48*b* indicate two opposite metal supporting members or first and second supporting members for supporting the catalytic element 42. The supporting member 48*a* is composed of an annular flange portion 50 and a radial annular disc portion 52 integral with the flane portion 50. The supporting member 48*a* is secured at its flange portion 50 to the inner surface of the cylindrical portion 36 of the casing 32 and contacts at its annular disc portion 52 the peripheral portion of the annular plane 42 of the catalytic element 42. As clearly shown, the supporting member 48*b* is of similar construction to the supporting member 48*a* and accordingly the annular flange portion 50 of the supporting member 48*b* is secured to the inner surface of the cylindrical portion 36 of the casing 32, and the radial annular disc portion 52 is in contact with the peripheral portion of the annular plane 42*b* of the catalytic element 42. It will be understood that the radial annular disc portions 52 of the supporting members 48*a* and 48*b* define openings 54*a* and 54*b*, respectively.

As best seen in FIGS. 3 and 4, the radial annular disc portion 52 of the supporting member 48*a* is formed with a plurality of radial slits which may be slits 52*a* which define considerable openings as indicated in FIG. 3, or be slits 52*a*' which do not define any openings therethrough as indicated in FIG. 4. The slits 52*a* or 52*a*' are, as shown, formed suitably spaced from each other to extend radially from the inner peripheray 52*b* to the outer periphery 52*c* of the radial annular disc portion 52. The annular disc portion 52 is integral at the outer periphery with the flange portion 50. It is to be noted that the radial annular disc portion 52 of another supporting member 48*b* is also formed with the slits 52*a* or 52*a*' similar to the supporting member 48*a*, though not shown.

With the catalytic converter arrangement hereinbefore described, the exhaust gases discharged from the automotive internal combustion engine are introduced through the gas inlet 38 into the gas flow channels 44 of the monolithic catalytic element 42. Then, the noxious constituents contained in the exhaust gases are converted into harmless compounds by contacting the catalytic material carried on the surfaces of the gas flow channels 44. At this time, if the radial annular disc portions 52 of the supporting members 48*a* and 48*b* are subjected to an excessively high temperature, thermal stresses generated by the high temperature are released from the radial annular disc portions 52 because the annular disc portion 52 is separated into a plurality of small pieces. Accordingly, the annular disc portions 52 do not warp or deform to apply local mechanical force at the peripheral portions of the annular planes 42*a* and 42*b* of the catalytic element 42, and consequently the catalytic element 42 is not damaged or broken at all. It will be understood that although the slits 52*a* or 52*a*' extend to the outer periphery of the radial annular disc portion 52, the exhaust gases introduced through the gas inlet 38 is not allowed to flow from the upstream side into the downstream side of the catalytic element 42 through the slits 52*a* or 52*a*' and the supporting member 46 because the supporting member 46 serves as a sealing member.

Figure 5:
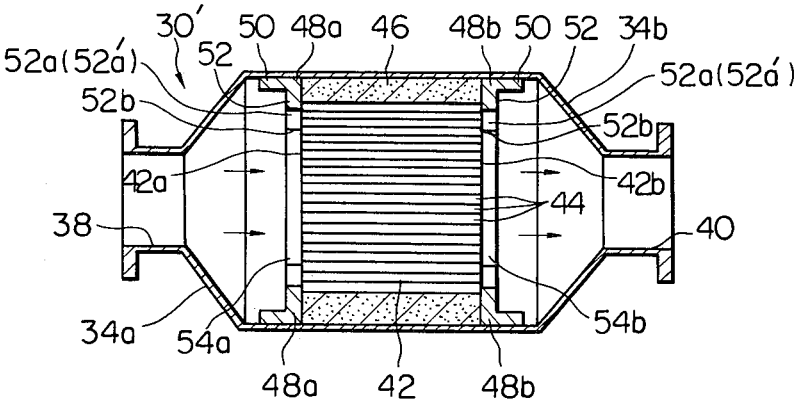
FIG. 5 is a schematical sectional view of another preferred embodiment of the catalytic converter according to the present invention.

FIG. 5 illustrates another preferred embodiment of the catalytic converter 10' according to the present invention, which converter 10' is similar to the embodiment of FIG. 2 except for the radial direction supporting member 46 and the shape of the slits 52*a* and 52*a*' of the radial annular disc portions 52. In this instance, the supporting member 46 is formed of coiled wires, corrugated metal meshes or wound metal mesh fabrics which are poor in sealing effect of the exhaust gases and allow the exhaust gases to pass therethrough. In order to prevent the gas flow through the supporting member 46 of the poor gas sealing effect, each slit 52*a* and 52*a*' is not formed to reach the outer periphery of the radial annular disc member 52, but is formed to extend from the inner periphery 52*b* of the annular portion 52 to a predetermined point which does still not reach the level corresponding to the outer periphery of the cylindrical catalytic element 42. It will be appreciated that the exhaust gases containing unreacted noxious constituents are prevented from by-passing the catalytic element 42.

As is apparent from the foregoing discussion, according to the present invention, the monolithic honeycomb type catalytic element is prevented from damage due to warp of the supporting member 46 merely by forming a plurality of slits 52*a* and 52*a*' in the radial annular disc portions 52 in the supporting members 46. Accordingly, this improves the durability of the catalytic element 42.

What is claimed is:

1. A catalytic converter for purifying exhaust gases emitted from an automotive internal combustion engine, comprising:

a cylindrical catalytic casing defining an enclosed cylindrical space, and having a gas inlet and a gas outlet;

a cylindrical catalytic element of lesser diameter than the enclosed space and positioned within said casing, said catalytic element being of a unitary, solid monolithic structure having a plurality of gas flow channels therethrough, and a catalytic material on the surface of the channels, said catalytic element having first and second parallel circular planes, the first circular plane facing the gas inlet of said casing for introducing the gases in said casing therethrough into gas flow channels of said catalytic element, the second circular plane facing the gas outlet of said casing for feeding the gases from the gas flow channels of said catalytic element therethrough into the gas outlet of said casing;

a radial supporting member disposed between the inner surface of said casing and the outer surface of said catalytic element for supporting said catalytic element radially and concentrically with said casing;

a first supporting member for supporting said catalytic element to prevent said catalytic element from axial movement, said first supporting member including an annular flange portion whose outer periphery is directly secured to the inner surface of said casing, and a radial annular disc portion integral with the annular flange portion and radially concentrical with said casing, said radial annular disc portion being contactable with the peripheral portion of the first circular plane of said catalytic element;

means defining a plurality of slits in the radial annular disc portion of said first supporting member, the slits radially extending from the inner periphery of the radial annular disc portion to the outer periphery of the same;

a second supporting member for supporting said catalytic element to prevent said catalytic element from axial movement, said supporting member including an annular flange portion whose outer periphery is directly secured to the inner surface of said casing and a radial annular disc portion with an annular flange portion and radially concentrical with said casing, said radial annular disc portion being contactable with the peripheral portion of the second circular plane of said catalytic element; and means defining a plurality of slits in the radial annular disc portion of said second supporting member, the slits radially extending from the inner periphery of the radial annular disc portion to the outer periphery of the same.

2. A catalytic converter as claimed in claim 1, in which the radial annular disc portions of said first and second supporting members are integral at their outer peripheries with the annular flange portions of the same and define by their inner peripheries circular openings.

3. A catalytic converter as claimed in claim 2, in which said radial supporting member is formed of a material impervious to exhaust gas for preventing the exhaust gases from passing therethrough.

4. A catalytic converter as claimed in claim 3, in which said radial supporting member is formed of asbestos.

5. A catalytic converter as claimed in claim 3, in which said radial supporting member is formed of ceramic fibers.

* * * * *